US005419525A

United States Patent [19]

Hilton

[11] Patent Number: 5,419,525

[45] Date of Patent: May 30, 1995

[54] COMPUTER STAND

[75] Inventor: Carl Hilton, Bellair Shore, Fla.

[73] Assignee: Carl Hilton Corporation, Largo, Fla.

[21] Appl. No.: 165,675

[22] Filed: Dec. 13, 1993

[51] Int. Cl.[6] ..... A47G 29/00

[52] U.S. Cl. ..... 248/371; 248/639; 248/918; 248/923; 108/6; 108/50; 312/223.3

[58] Field of Search ..... 248/371, 397, 440, 163.1, 248/440.1, 917–923, 639, 676; 108/6, 3, 50; 312/223.3, 194

[56] References Cited

U.S. PATENT DOCUMENTS

| | | | |
|---|---|---|---|
| 4,515,086 | 5/1985 | Kwiecinski et al. | 248/918 X |
| 4,566,741 | 1/1986 | Ericksson et al. | 248/371 X |
| 4,632,349 | 12/1986 | Anstey | 248/918 X |
| 4,640,199 | 2/1987 | Zigman | 108/6 |
| 4,725,106 | 2/1988 | Shields et al. | 108/3 X |
| 4,884,773 | 12/1989 | Becker | 248/918 X |
| 5,118,172 | 6/1992 | Ugalde | 108/6 X |
| 5,357,873 | 10/1994 | Hilton | 108/50 |

FOREIGN PATENT DOCUMENTS

| | | | |
|---|---|---|---|
| 128263 | 12/1984 | European Pat. Off. | 108/6 |
| 1303918 | 8/1962 | France | 108/6 |
| 4009536 | 9/1991 | Germany | 312/223.3 |
| 4100675 | 7/1992 | Germany | 312/223.3 |

*Primary Examiner*—Karen J. Chotkowski

*Attorney, Agent, or Firm*—Dorn, McEachran, Jambor & Keating

[57] ABSTRACT

A computer stand has shelves for supporting a keyboard and monitor pivotally connected to a pivot rod which is transversely supported between side frames at the front thereof. Rear cross beams connect the side frames. Monitor and keyboard braces allow independent adjustment of the angles of the shelves. The height of the keyboard shelf and monitor shelf is also adjustable. Printer and CPU shelves may also be mounted on the side frames.

12 Claims, 3 Drawing Sheets

Fig. 2.
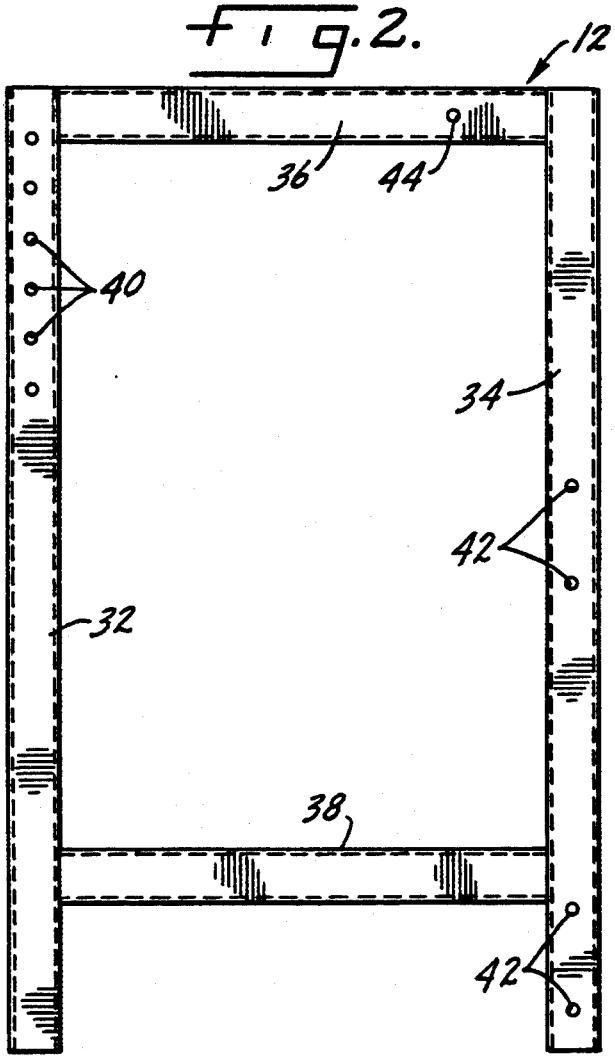
Fig. 7.
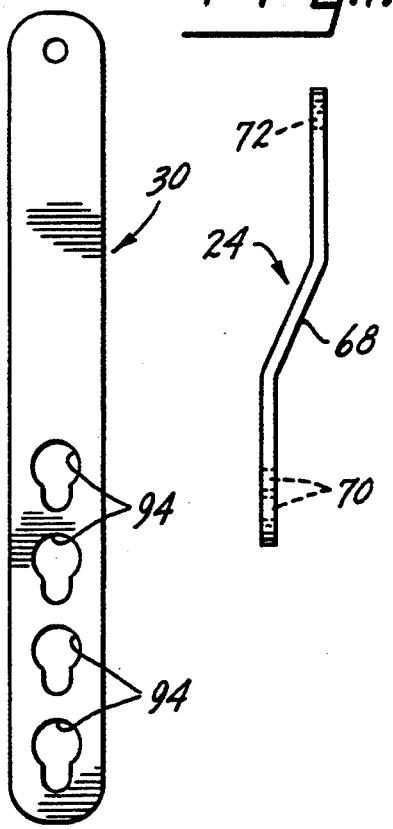
Fig. 12.
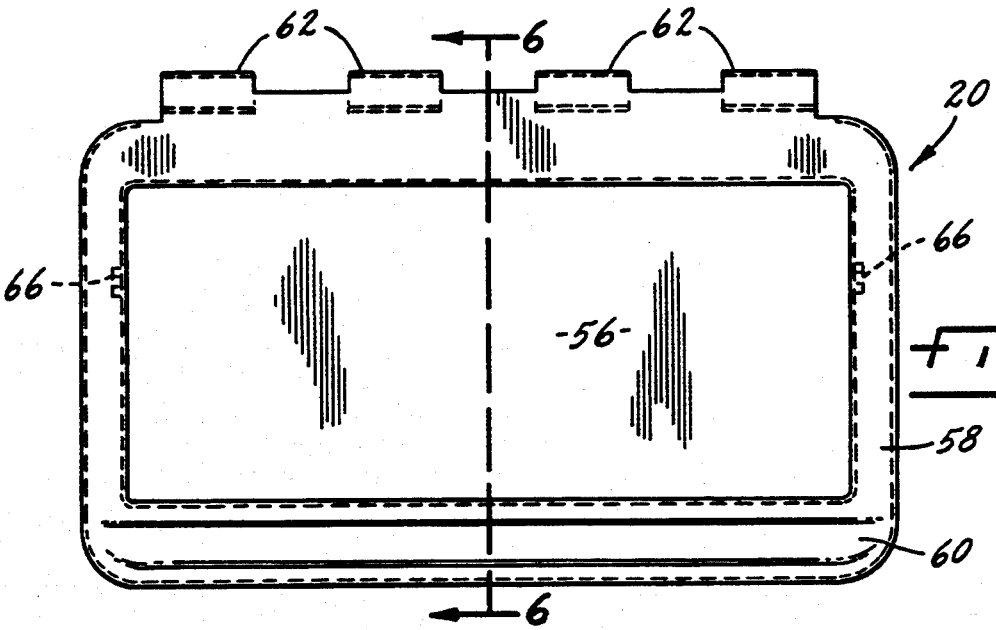
Fig. 5.

COMPUTER STAND

This invention relates to furniture suitable for supporting personal computer equipment and the like. The present invention provides an economical stand which places the keyboard, monitor and CPU within easy sight and reach of the operator. The invention is particularly concerned with a computer stand for adjustably supporting a keyboard and monitor in front of a seated operator.

The monitor is placed on an angled monitor shelf disposed within the stand such that the monitor screen will be located immediately forward of the keyboard and at an angle, minimizing head and neck motion when the keyboard and monitor are viewed in sequence. The height and angle of the monitor can be adjusted by the operator. The keyboard tray is angled downwardly toward the operator, reducing fatigue and tension in the operator's hands and wrists. The height and angle of the keyboard tray are adjustable to suit a particular operator.

A CPU shelf is associated with the stand, adjacent to the monitor shelf, out of the way but still within a convenient hand's reach of the operator. An optional printer tray can be placed immediately above the monitor, enabling the operator to operate the printer with a minimum amount of head or body motion. The printer tray, or other auxiliary device, is mounted on the rear corners of the stand. These features combine to result in reduced operator fatigue, higher efficiency and an overall improvement in the quality of the working environment.

The components of the stand can be shipped in a relatively compact container. On-site assembly does not require special expertise and is readily accomplished with a few simple tools.

BRIEF DESCRIPTION OF THE DRAWINGS

FIG. 2 side elevation view of the inside of the left-hand side frame.

FIG. 5 is a top plan view of the keyboard tray.

FIG. 7 is a plan view of the keyboard brace.

FIG. 12 is an elevational view of a monitor support strap.

DETAILED DESCRIPTION OF THE INVENTION

Figure 1:
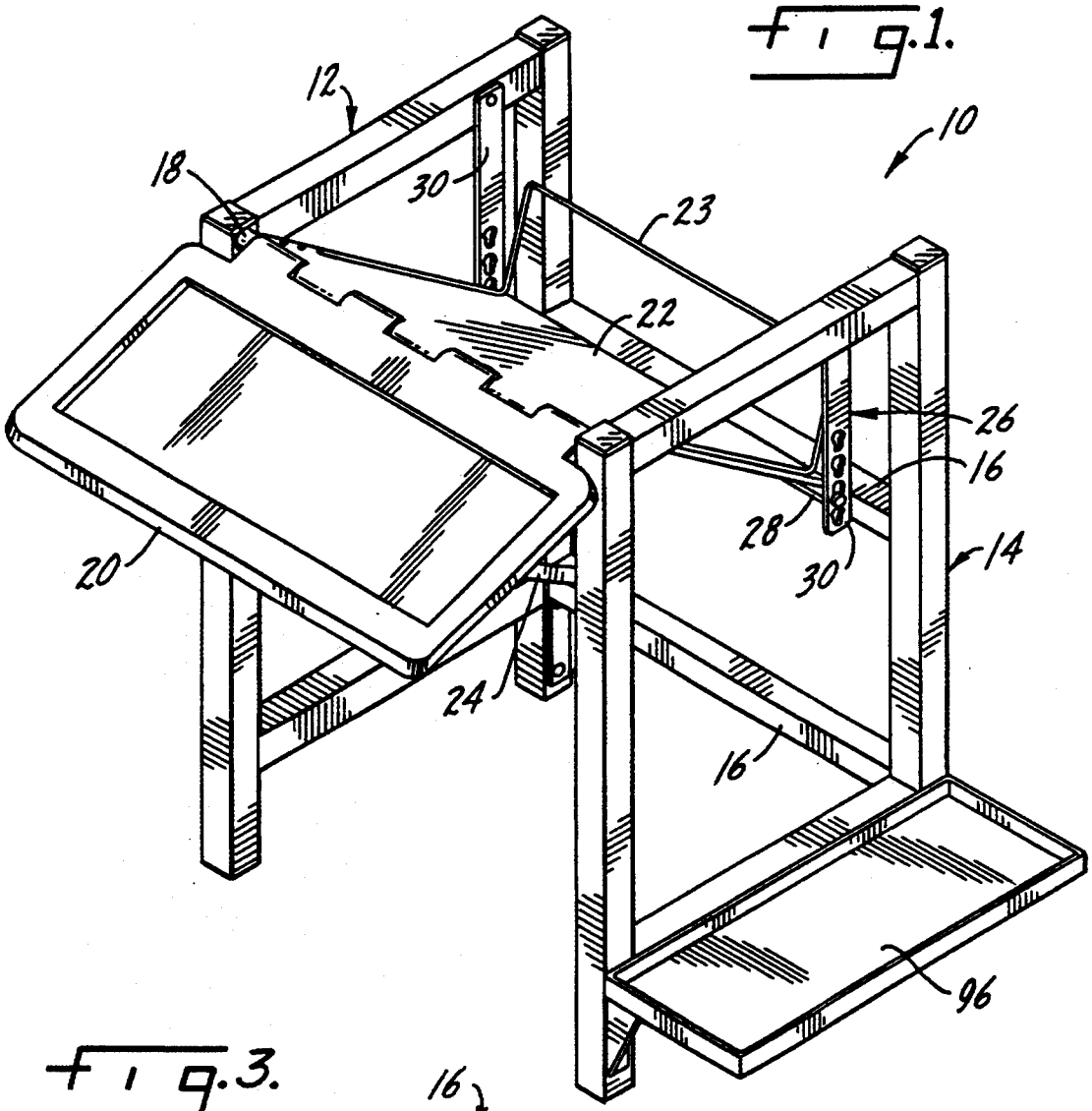
FIG. 1 is a perspective view of the assembled stand.

FIG. 1 illustrates the computer stand of the present invention generally at 10, The stand includes left hand and right hand frame members 12 and 14. Details of the frame members will be described below. The frame members are joined at the rear portions thereof by cross beams 16. The cross beams have brackets which are preferably bolted to the side frame members. The upper cross beam is attached somewhat below the top, rear corners of the frame members 12 and 14 to accommodate larger monitors.

The basic structure of the computer stand is completed by a pivot rod 18 extending transversely of the frame members at an upper front portion thereof. A keyboard tray 20 is pivotally attached to the pivot rod 18. A monitor shelf 22 is also pivotally attached to the rod 18. The monitor shelf 22 has a monitor retention bracket 23 attached to it for holding a monitor. For reference purposes only the dimensions of the computer stand are about 21¼" wide by 18" deep by 29¼" high.

It will be noted that the keyboard tray 20 and monitor shelf 22 have interleaved, rounded hooks which form a piano-type hinge about the pivot rod 18. Thus, both the keyboard tray 20 and monitor shelf 22 are pivotable about the rod 18. The position or angle of the keyboard tray is determined by two keyboard braces, one of which is visible at 24. The braces 24 extend between brackets on the side edges of the keyboard tray and the inside surfaces of the front side frame legs. Details of this will be shown below.

The monitor shelf 22 is supported at its edge opposite the hinge by a monitor brace 26. The monitor brace includes a monitor pivot 28 whose ends extend into openings in a pair of straps 30. The straps are pivotally connected to the upper members of the side frames 12 and 14 respectively.

Details of the components shown in FIG. 1 will now be described. FIG. 2 shows the left hand side frame 12. It will be understood that the right hand side frame 14 is similar to the side frame 12 in FIG. 2. The side frame includes front and rear legs 32 and 34 joined by upper and lower side beams 36 and 38. The legs and side beams are preferably made of 1½" square tubes which are welded together. The tops of the legs are preferably closed by caps. A series of six nuts 40 are affixed to the inside of the front leg 32, about 1½" apart. These nuts receive bolts placed through openings in the keyboard brace 24 for fixing the angle of the keyboard tray. Nuts 42 on the rear leg 34 receive bolts through bracket 48 (FIG. 3) of the cross beams 16 for securing the cross beams to the side frames. A nut 44 receives a bolt which extends through the monitor shelf strap 30.

Figure 3:
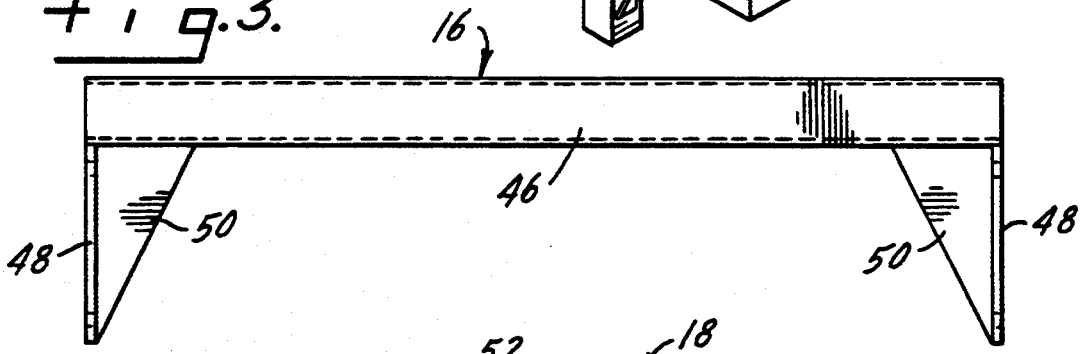
FIG. 3 is a front elevation view of a cross-brace.

FIG. 3 shows details of the rear cross beams 16. Each beam has an elongated, square tubular member 46 with depending brackets 48 welded to each end. The brackets have openings for receiving the bolts (not shown) which fit into nuts 42 in the rear legs 34. The brackets 48 are reinforced by triangular gussets 50.

Figure 4:
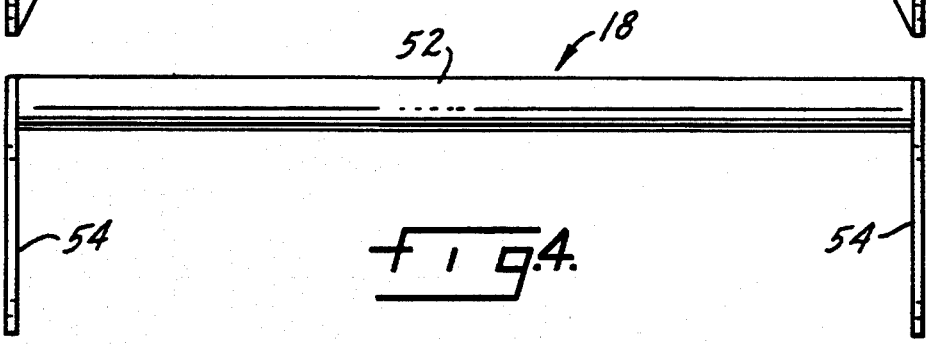
FIG. 4 is a front elevation view of the pivot rod.

FIG. 4 shows the pivot rod 18. It has an elongated 1" diameter tube 52 of circular cross-section with depending plates 54 welded thereto on either end. The plates 54 have openings for receiving two bolts which are threaded into nuts 40 on the front legs of the frame members. The height of the pivot rod 18, and thus, the height of the keyboard and monitor can be adjusted by selecting the appropriate set of nuts 40 for the desired height. Obviously, more than the six nuts 40 could be provided to afford a greater range of adjustability.

Figure 6:
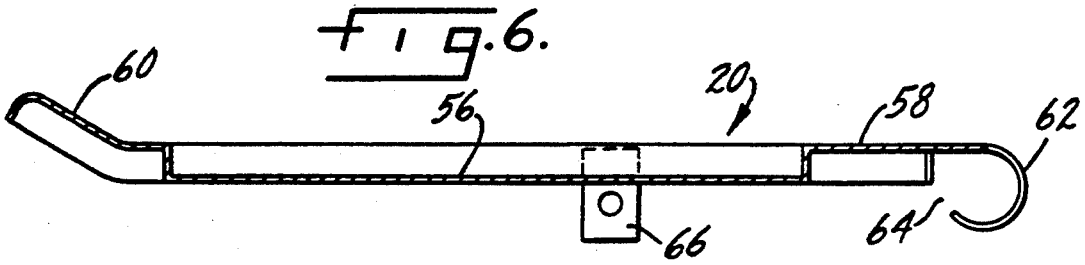
FIG. 6 is a section taken along line 6—6 of FIG. 5.

FIGS. 5 and 6 illustrate the keyboard tray 20. The tray comprises a generally flat plate 56 surrounded by an upraised frame portion 58 which includes a wrist rest 60. Extending from the frame 58 on the side opposite the wrist rest 60 are four hooks 62. The hooks are generally circular with a gap as at 64 (FIG. 6) which permits them to be snapped around the pivot rod 18. A pair of brackets 66 on either side of the frame 58 provide a mounting location for bolts (not shown) which connect to the keyboard braces 24.

A keyboard brace is shown in FIG. 7. It has an angled portion 68 which permits the brace to fit against the inside surface of the front legs. One end of the brace 24 has a pair of openings 70 while the other end has a single opening 72. The single opening is bolted to the brackets 66 of the keyboard tray while the openings 70 receive bolts which fit into the nuts 40 of the frame members.

Figure 8:
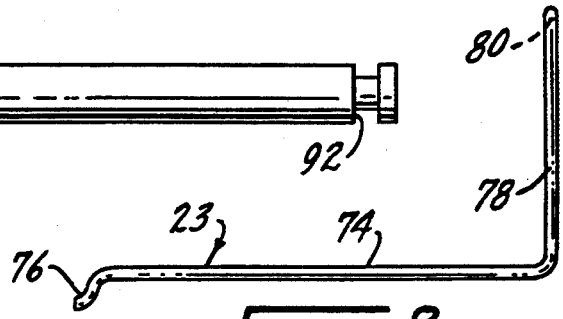
FIG. 8 is a side elevation view of the monitor retention bracket.

The monitor support bracket 23 is shown in FIG. 8. It has a pair of legs 74 with feet 76 on the ends thereof. The legs are attached to uprights 78 which are joined by a central bar 80. The feet 76 fit through openings in the monitor shelf and the legs 74 rest along the sides of the shelf. The uprights 78 and bar 80 engage the monitor to hold it on the shelf.

Figure 9:
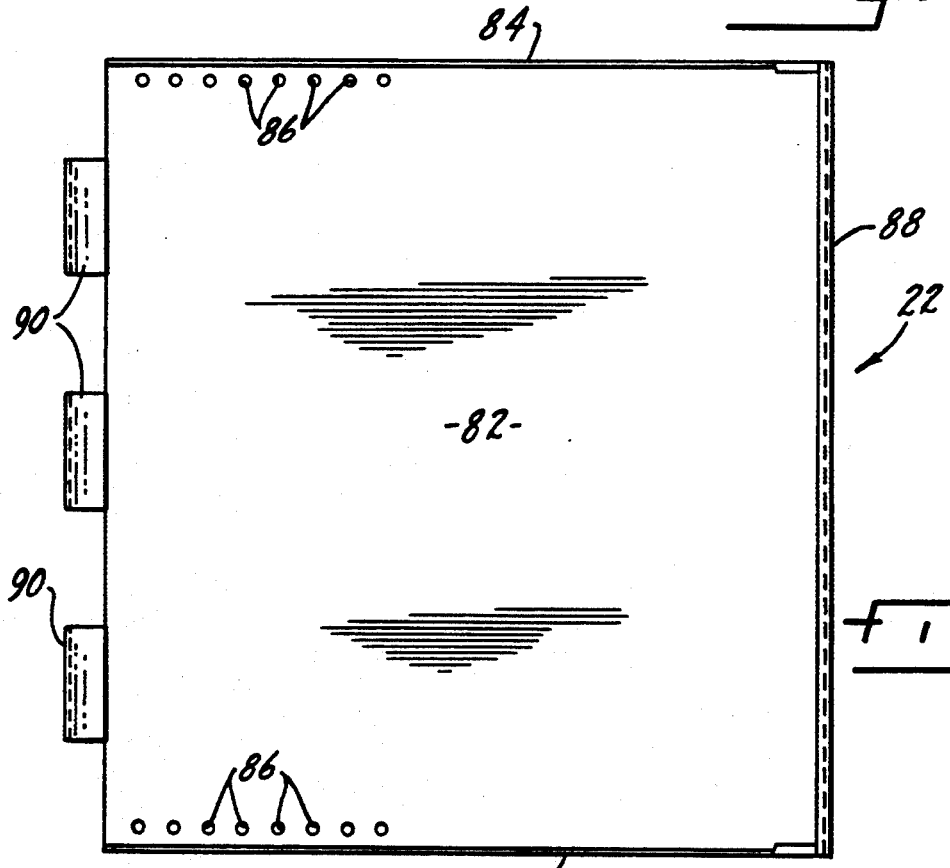
FIG. 9 is a bottom plan view of the monitor shelf.
Figure 10:
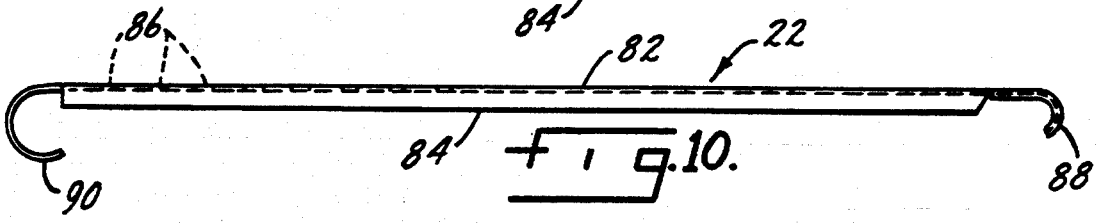
FIG. 10 is a side elevation view of the monitor shelf.

The monitor shelf itself is shown in FIGS. 9 and 10. The monitor shelf has a central panel 82 with an upturned lip 84 on its lateral edges. The central panel has a series of openings 86 which receive the feet 76 of the bracket 23. The openings permit adjustability of the depth of the bracket 23. The lip 84 is bent over flat near the end opposite the openings 86. The rearmost edge of the monitor shelf has a curved extension portion 88. The extension extends the entire width of the shelf and engages the monitor pivot 28. The side of the shelf opposite the extension 88 has three round hooks 90 which are spaced so that they interleave with the hooks 62 of the keyboard tray. The hooks are rounded as seen in FIG. 10 and can be snapped over the pivot rod 18.

Figure 11:
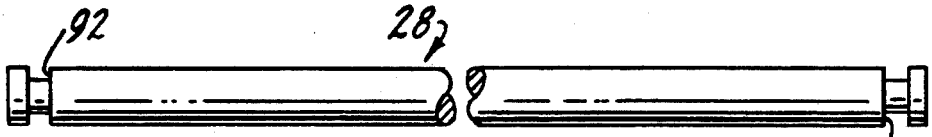
FIG. 11 is a view of the monitor rod.

FIG. 11 shows the monitor pivot 28. It is simply a round shaft having a pair of notches 92 near each end. The notches engage keyhole-shaped openings 94 in the straps 30 as shown in FIG. 12.

Additional optional features of the stand include a CPU bracket 96 which can be attached along the outside of one of the frame members. See FIG. 1. A shelf for a printer or the like can be added by removing the caps from the rear legs and inserting a pair of rods which support an elevated platform or shelf for holding the printer. A mouse shelf and/or a stationery holder could be attached to the front legs either by bolts or by rods extending into the legs after removing the caps.

It can be seen that the present invention affords a computer stand having adjustable angles for both the keyboard tray and monitor shelf and an adjustable keyboard/monitor height. The keyboard angle is adjusted by selecting an appropriate combination of brace hole 70 and nut 40 to support the tray. The keyboard and monitor height is adjusted by selecting the appropriate set of nuts 40 for the connecting bolts supporting the pivot rod plates 54. The monitor shelf angle is selected by choosing which of the strap openings 94 is engaged by the notches 92 of the monitor pivot 28.

It can be seen that an inexpensive, compact computer stand has been shown and described. Whereas a preferred form of the invention has been described, it will be realized that modifications may be made thereto without departing from the scope of the following claims.

I claim:

1. A stand for supporting components of a computer or the like, comprising: spaced left and right frame members which are joined by at least one cross beam at a rear portion thereof; a pivot rod connected between the frame members at a front portion thereof;

a keyboard tray pivotally connected to the pivot rod and extending forwardly from the pivot rod;

at least one keyboard brace connected between a frame member and the keyboard tray for adjustably fixing the position of the keyboard tray;

a monitor shelf pivotally connected the pivot rod and extending rearwardly from the pivot rod; and at least one monitor brace connected between the monitor shelf and at least one of a frame member or a cross beam for adjustably fixing the position of the monitor shelf.

2. The structure of claim 1 further comprising a shelf attached to one of the frame members for supporting a CPU.

3. The structure of claim 1 wherein the monitor shelf includes a bracket engageable with a monitor for retaining the monitor thereon.

4. The structure of claim 1 wherein the monitor brace comprises a monitor rod connected to the monitor shelf remote from the pivot rod, the ends of the monitor rod extending into one of a series of openings in a pair of straps pivotally attached to the side frames.

5. The structure of claim 1 wherein the keyboard brace comprises a pair of brace members extending between the keyboard shelf and one of a series of connecting points on the side frames.

6. The structure of claim 1 wherein the connection of the pivot rod to the frame members is height adjustable to adjust the height of the keyboard tray and monitor shelf.

7. A stand for supporting components of a computer or the like, comprising:

first and second front legs joined by a transverse pivot rod;

first and second rear legs joined to the front legs by at least one side beam and to each other by at least one cross beam;

a keyboard shelf and a monitor shelf each having an edge pivotally connected to the pivot rod, the shelves extending on opposite sides of the pivot rod at an angle thereto;

brace means for adjustably fixing the angle of the keyboard and monitor shelves.

8. The structure of claim 7 further comprising a shelf attached to one of the side beams for supporting a CPU.

9. The structure of claim 7 wherein the monitor shelf includes a bracket engageable with a monitor for retaining the monitor thereon.

10. The structure of claim 7 wherein the brace for the monitor comprises a monitor rod parallel to the pivot rod and connected to the monitor shelf remote from the pivot rod, the ends of the monitor rod extending into one of a series of openings in a pair of straps pivotally attached to the side beams.

11. The structure of claim 7 wherein the brace for the keyboard comprises a pair of brace members extending between the keyboard shelf and one of a series of connecting points on the front legs.

12. The structure of claim 7 wherein the connection of the pivot rod to the frame members is height adjustable to adjust the height of the keyboard tray and monitor shelf.

* * * * *